US006889665B2

(12) United States Patent
Rembold

(10) Patent No.: US 6,889,665 B2
(45) Date of Patent: May 10, 2005

(54) HIGH PRESSURE PUMP FOR A FUEL SYSTEM OF AN INTERNAL COMBUSTION ENGINE, AND A FUEL SYSTEM AND INTERNAL COMBUSTION ENGINE EMPLOYING THE PUMP

(75) Inventor: Helmut Rembold, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,715

(22) PCT Filed: May 24, 2002

(86) PCT No.: PCT/DE02/01888

§ 371 (c)(1),
(2), (4) Date: Sep. 16, 2003

(87) PCT Pub. No.: WO02/097268

PCT Pub. Date: Dec. 5, 2002

(65) Prior Publication Data

US 2004/0047746 A1 Mar. 11, 2004

(30) Foreign Application Priority Data

May 26, 2001 (DE) ..... 101 25 784
Mar. 27, 2002 (DE) ..... 102 13 625

(51) Int. Cl.[7] ..... F02M 37/04

(52) U.S. Cl. ..... 123/509; 123/495; 92/153; 417/228

(58) Field of Search ..... 123/506, 495; 92/153, 157, 156, 158, 159, 66, 71; 417/228

(56) References Cited

U.S. PATENT DOCUMENTS 3,744,380 A * 7/1973 Steiger ..... 92/61
3,765,183 A * 10/1973 Baurle ..... 60/491
3,828,657 A * 8/1974 Neuman ..... 92/258
3,975,993 A * 8/1976 Friedrichs ..... 92/129
4,581,980 A * 4/1986 Berthold ..... 92/12.2
5,931,644 A * 8/1999 Glassey et al. ..... 417/269
5,944,493 A 8/1999 Albertin
6,368,072 B1 * 4/2002 Inoue et al. ..... 417/269
6,390,072 B1 * 5/2002 Breeden ..... 123/509
6,447,273 B1 * 9/2002 Nishimura et al. ..... 417/505

FOREIGN PATENT DOCUMENTS

DE 1 653 388 10/1971
DE 44 99 555 T1 11/1996
DE 19705205 * 8/1998
DE 199 20 168 A1 11/1999
DE 199 00 564 A1 7/2000
EP 1 101 940 A2 5/2001

* cited by examiner

*Primary Examiner*—Carl S. Miller
(74) *Attorney, Agent, or Firm*—Ronald E. Greigg

(57) ABSTRACT

A high-pressure piston pump for a fuel system of an internal combustion engine, includes a housing, a piston, which defines a working chamber, and drive shaft having at least one crank section and supported in the housing by means of at least one shaft bearing. A piston bearing supports the piston at least indirectly against the crank section of the drive shaft. At least one of the bearings between parts that move in relation to one another is a hydrostatic bearing connected to the working chamber by means of a fluid connection. To increase efficiency, the fluid connection between the working chamber and the hydrostatic bearing is provided with a device operable to intermittently interrupt the fluid connection.

18 Claims, 6 Drawing Sheets

HIGH PRESSURE PUMP FOR A FUEL SYSTEM OF AN INTERNAL COMBUSTION ENGINE, AND A FUEL SYSTEM AND INTERNAL COMBUSTION ENGINE EMPLOYING THE PUMP

CROSS-REFERENCE TO RELATED APPLICATIONS

This application is a 35 USC 371 application of PCT/DE 02/01888 filed on May 24, 2002.

BACKGROUND OF THE INVENTION

1. Field of the Invention

The current invention relates to a high-pressure piston pump for a fuel system of an internal combustion engine, with a housing, at least one piston that defines a working chamber, a drive shaft that is supported in the housing by at least one shaft bearing and has at least one crank section, and a piston bearing that supports the piston at least indirectly against the crank section of the drive shaft, wherein at least one of the bearings between parts that move in relation to one another is a hydrostatic bearing, which is connected to the working chamber by means of a fluid connection.

2. Description of the Prior Art

A pump piston of the type with which this invention is concerned, in the form of a radial piston pump, is known from DE 197 05 205 A1. In this radial piston pump, a bearing race is placed onto the eccentric section of a drive shaft. This bearing race has a flat contact surface against which a sliding block of an axially reciprocating piston rests. Between the contact surface of the bearing race and the sliding block, there is a relief chamber, which communicates with a working chamber defined by the piston via axial bores in the sliding block and in the piston. When the piston executes a delivery stroke, the pressure in the working chamber increases, which is conveyed through the bore in the piston to the relief chamber and thus leads to a reduction in the contact force between the sliding block and bearing race. The relief chamber thus constitutes a hydrostatic bearing. This reduces the friction and wear between the sliding block and bearing race.

Although the efficiency of the known piston pump during operation has in fact proven to be favorable, it is nevertheless not yet optimal.

The object of the current invention, therefore, is to modify a piston pump of the known type so that it has an even better efficiency.

This object is attained in a piston pump of the type mentioned above by virtue of the fact that the fluid connection between the working chamber and hydrostatic bearing is provided with a device that can intermittently interrupt the fluid connection.

SUMMARY OF THE INVENTION

The invention proceeds from the recognition that a leakage occurs in the vicinity of the chamber between the parts that move in relation to one another, i.e. fluid, which is to be supplied by the piston pump, travels as leakage fluid through the hydrostatic bearing and, for example, back to the inlet of the piston pump. This leakage is detrimental to the efficiency of the piston pump. It has also been established that it is not necessary to relieve the pressure on a bearing at all times during a work cycle of the piston pump. In essence, it makes sense to relieve the pressure of the bearing parts, which rest against each other and move in relation to each other, only at those times in which these two parts are pressed against each other with a relatively powerful force. In the case of a piston pump, this is essentially the case during the delivery stroke.

By providing the fluid connection between the working chamber and the hydrostatic bearing with a device that can intermittently interrupt the fluid connection, the invention makes it possible to sufficiently limit the time during which fluid flows from the working chamber into the hydrostatic bearing. This reduces the leakage quantity of fluid during operation of the piston pump without undesirably increasing the friction between parts of a piston pump bearing that move in relation to each other. Consequently, the efficiency of the piston pump is increased without shortening the service life of the piston pump.

The invention proposes including a pressure relief valve in the device that can intermittently interrupt the fluid connection. This pressure relief valve is incorporated into the fluid connection so that it opens this fluid connection only if the pressure in the region of the fluid connection oriented toward the working chamber exceeds a threshold value. This is based on the concept that the stresses on the bearings are at their greatest when the pressure in the working chamber is high. A piston pump of this kind is simple in design and operates reliably.

It is also possible to include an on-off valve in the device that can intermittently interrupt the fluid connection. In this modification, therefore, it is possible to select at will the times at which the hydrostatic bearing is connected to the working chamber and the times at which this connection is interrupted. This permits the fluid quantity used for the hydrostatic bearing to be reduced even further.

In this connection, it is particularly preferable if the on-off valve is the quantity control valve of the piston pump. A quantity control valve of this kind is usually used to temporarily short-circuit the outlet of the piston pump to its inlet toward the end of a delivery stroke, thus limiting the quantity of the effectively delivered fluid. In this modification, hardly any fluid is lost to produce the hydrostatic bearing since the production of this hydrostatic bearing uses only the fluid, which, in order to limit the delivery quantity, is not supposed to travel to the actual outlet of the piston pump anyway, but is conveyed back to its inlet.

The piston pump according to the invention is relatively small if the device that can intermittently interrupt the fluid connection is accommodated in the piston. However, it is also possible to accommodate it in the housing of the piston pump. This makes it easier to access the device, e.g. for maintenance purposes.

The considerably reduced fluid quantity required to generate a hydrostatic bearing in the piston pump according to the invention makes it possible to embody several or possibly even all of the highly stressed bearings in the piston pump with such a hydrostatic bearing. This potential is realized by the modification in which at least one hydrostatic bearing is respectively provided in the piston bearing and in the shaft bearing.

The hydrostatic bearing can contain a chamber, which is limited in the azimuth direction. This reduces the volume of the chamber and consequently reduces the fluid quantity required to generate a hydrostatic bearing. Such a limitation of the chamber does not result in any significant increase in the bearing friction forces since the hydrostatic bearing only has to work in the direction of the force peaks. These peaks naturally occur primarily when the piston is disposed in the vicinity of its top dead center and the fluid enclosed in the working chamber is thus maximally compressed.

The piston pump according to the invention can be embodied as a single cylinder piston pump and as a multi-cylinder piston pump. The angular range over which the chamber extends in the azimuth direction is preferably less than 360°/2 times the number of pistons.

The length and the width of the chamber are used to produce a hydrostatic bearing that is optimal for each individual application.

Another modification is characterized in that the fluid connection is connected to a pressure damper. This pressure damper can be embodied as a compression volume, spring bellows, diaphragm chamber, or the like. Such a pressure damper can be used to shape the chronological course of the fluid flow that flows from the working chamber to the chamber. This is particularly advantageous if the device that can intermittently interrupt the fluid connection is the quantity control valve of the piston pump. If this quantity control valve is opened toward the end of the delivery stroke, then an abrupt pressure increase occurs in the fluid connection and consequently also in the chamber. This pressure increase can be flattened somewhat by means of such a pressure damper.

This goal is shared by the modification in which at least one flow throttle is provided between the fluid connection and the pressure damper. For example, when a pressure relief valve or an on-off valve is used, such a flow throttle reduces the chronological pressure gradient in the fluid connection and extends the time of the pressure increase somewhat. The hydrostatic bearing is consequently available for a longer time than the fluid connection is open between the chamber and the working chamber.

The fluid connection to the chamber in the shaft bearing can include a flow conduit in the housing, which is connected to an annular groove in a bearing shell or in the shaft, which annular groove is connected to a radial bore in the shaft, which radial bore is connected to an axial bore in the shaft, which axial bore is connected to a radial bore in the shaft, which radial bore feeds into the chamber in the shaft bearing. Bores of this kind are easy to produce, which simplifies the production of the fluid connection.

The same is also true for the fluid connection, which leads to the chamber in the piston bearing and which includes a radial bore that leads away from the axial bore in the shaft and feeds into the chamber in the piston bearing.

The invention also relates to a fuel system for an internal combustion engine, with a fuel tank, a fuel pump that feeds into a fuel accumulation line, and at least one fuel injection device that is connected to the fuel accumulation line and injects the fuel directly into the combustion chamber of an engine.

In order to increase the efficiency of such a fuel system, the invention proposes that the fuel pump be embodied in the above-described manner.

The invention also relates to an internal combustion engine with at least one combustion chamber into which the fuel is directly injected. Such an engine is advantageously provided with a fuel system of the type mentioned above.

BRIEF DESCRIPTION OF THE DRAWINGS

Exemplary embodiments of the invention will be explained in detail below in conjunction with the accompanying drawings, in which.

DESCRIPTION OF THE PREFERRED EMBODIMENTS

Figure 1:
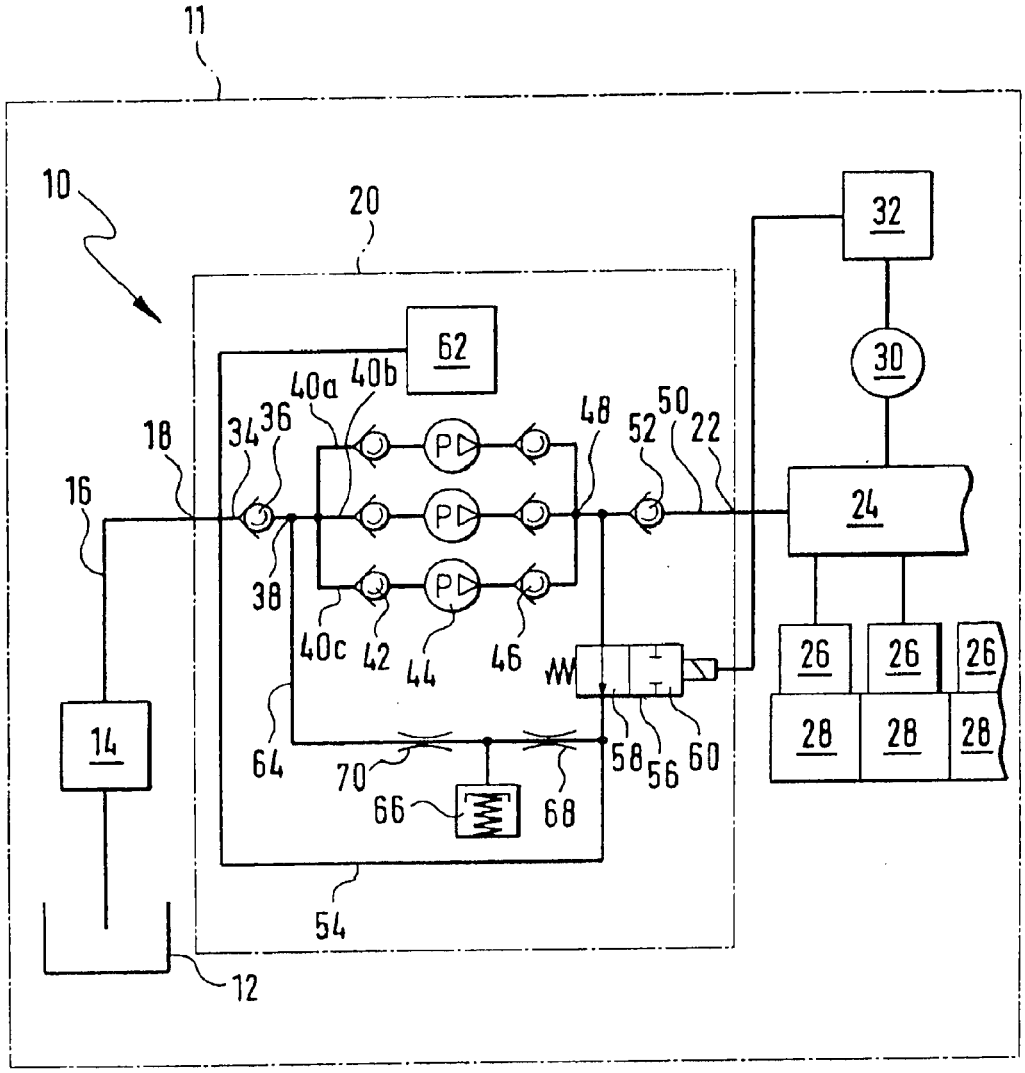
FIG. 1 is a schematic representation of a fuel system with a first exemplary embodiment of a fuel pump according to the invention.

In FIG. 1, a fuel system is labeled as a whole with the reference numeral 10. It is part of an internal combustion engine 11 and includes a fuel tank 12 from which an electric fuel pump 14 delivers the fuel into a fuel line 16. This fuel line 16 leads to an inlet 18 of a high-pressure fuel pump, which is labeled as a whole with the reference numeral 20 and which is driven by a crankshaft, not shown, of the internal combustion engine 11. The precise design of this high-pressure fuel pump will be discussed in detail below.

From an outlet 22, a fuel line (no reference numeral) leads to a fuel accumulation line 24, which is commonly also referred to as a "rail". A number of fuel injection devices 26 are connected to the fuel accumulation line 24. These devices are high-pressure injection valves or injectors. The latter are connected to the engine block (not shown) of an internal combustion engine (not shown) and inject the fuel directly into combustion chambers 28.

A pressure sensor 30 detects the pressure in the fuel accumulation line 24 and sends a corresponding signal to a control and regulation unit 32. In a manner that is not shown in detail, this unit in turn is connected at its output end to the high-pressure fuel pump 20. The high-pressure fuel pump 20 is a radial piston pump with three cylinders arranged in a star pattern. In principle, the high-pressure fuel pump 20 is designed as follows:

From the inlet 18, a flow conduit 34 leads through a check valve 36 to a branch point 38. The check valve 36 opens inward and thus protects the fuel line 16 and the electric fuel pump 14 from pressure surges. From the branch point 38, flow conduits lead to the individual cylinders 40*a*, 40*b*, and 40*c*. The cylinders 40*a*–40*c* are identically designed. For the sake of clarity, reference numerals are furnished for only one of the cylinders.

Each cylinder 40*a*–40*c* has a check valve 42 on the inlet side, a pump unit 44, and a check valve 46 downstream of the pump unit 44. Downstream of the check valves 46, the flow conduits of the individual cylinders 40*a*–40*c* come back together at a junction point 48. From there, a flow conduit 50 leads through another check valve 52 to the outlet 22 of the high-pressure fuel pump 20.

A flow conduit 54 branches off from the flow conduit 50 between the junction point 48 and the check valve 52 and this flow conduit 54 contains an on-off valve 56. This on-off valve is an electrically actuated 2/2-way on-off valve, which is open in its neutral position 58 and is closed in its actuated position 60. The control and regulation unit 32 controls the on-off valve 56. The flow conduit 54 leads from the on-off valve 56 to a hydrostatic bearing 62, which will be explained in detail below.

A flow conduit 64 branches off from the flow conduit 54 downstream of the on-off valve 56 and at its other end, this flow conduit 64 feeds into the flow conduit 34, between the check valve 36 and the branch point 38. The flow conduit 64 contains a pressure damper 66, which in this instance is a spring/piston chamber. However, it is also possible to embody the pressure damper 66 as a compression volume, spring bellows, diaphragm chamber, or the like. A first flow throttle 68 is provided upstream of the pressure damper 66 in the flow conduit 64 and another flow throttle 70 is provided downstream of the pressure damper 66 in the flow conduit 64.

Figure 2:
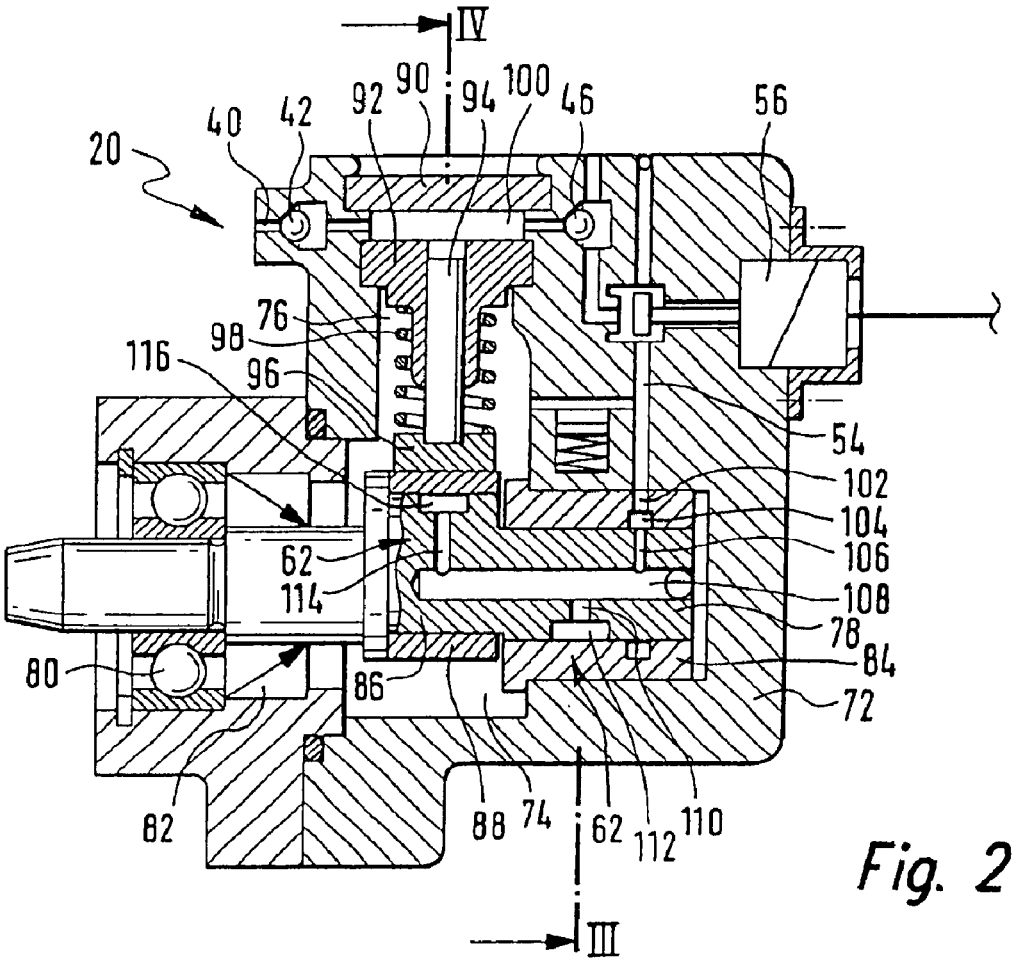
FIG. 2 is a partially sectional representation of the fuel pump from FIG. 1.
Figure 3:
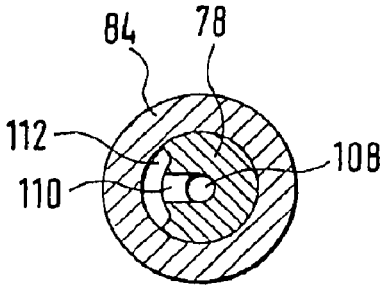
FIG. 3 shows a section along the line III—III from FIG. 2.
Figure 4:
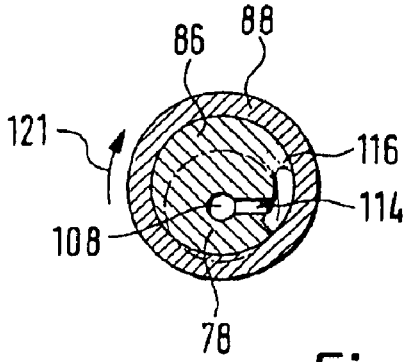
FIG. 4 shows a section along the line IV—IV from FIG. 2.

The precise embodiment of the high-pressure fuel pump 20 can be inferred from FIGS. 2–4. It should be noted that only one cylinder 40 is depicted in this intersecting plane and that individual conduits, etc. are not visible.

The high-pressure fuel pump 20 has a housing 72. This housing contains a blind bore-like recess 74 whose longitudinal axis extends horizontally in FIG. 2. The housing 72 also contains another recess 76, which extends vertically in FIG. 2, from the upper edge of the housing 72 into the horizontal recess 74. The horizontal recess 74 contains a drive shaft 78. This shaft is connected to the crankshaft (not shown) of the internal combustion engine.

The drive shaft 78 is supported in the vicinity of each of its two longitudinal ends by a bearing in the housing 72. The bearing on the left in FIG. 2 is labeled with the reference numeral 80. To the right of the bearing 80 in FIG. 2, the horizontal recess 74 is sealed in relation to the outside by a shaft seal 82. The right end of the drive shaft 78 is supported in a hollow, cylindrical bearing shell 84, which constitutes a shaft bearing. Approximately in its middle in the axial direction, the drive shaft 78 has an eccentric section 86, which is placed against a bearing race 88.

The vertical recess 76 is closed at the top by a cover 90. A guide sleeve 92 is inserted into the recess 76. This guide sleeve 92 in turn guides a piston 94 in an axially movable fashion. A foot 96 is welded to the bottom end of the piston 94 in FIG. 2. A compression spring 98 is clamped between the foot 96 and guide sleeve 92. This spring presses the foot 96 and consequently also the piston 94 against the bearing race 88. The bearing race 88 consequently constitutes a piston bearing (no reference numeral) that supports the piston 94 in relation to the drive shaft 78.

A working chamber 100 is provided above the piston 94 in FIG. 2. This chamber is fed from the left in FIG. 2 by the flow conduit that contains the check valve 42. The flow conduit that contains the check valve 46 extends from the working chamber 100 toward the right in FIG. 2. Neither the branch point 38 nor the junction point 48 is visible in the intersecting plane depicted in FIG. 2. The working chamber 100 and the piston 94 are part of the pump unit 44 of the cylinder 40 depicted.

The hydrostatic bearing 62 is designed as follows:

From the on-off valve 56, the flow conduit 54 leads to the horizontal recess 74. By means of a bore 102 in the bearing shell 84, the flow conduit 54 continues to an annular groove 104 on the inside of the bearing shell 84. At the same axial position as the annular groove 104, a radial bore 106 is let into the drive shaft 78 and feeds into an axial bore 108 in the drive shaft 78. This axial bore 108 extends into the eccentric section 86 of the drive shaft 78.

A radial bore 110 leads outward from the axial bore 108 to a recess (no reference numeral) on the outer circumferential surface of the drive shaft 78. As can be seen in FIG. 3, this recess extends in the azimuth direction over an angular range of approximately 60° (for the sake of clarity, only the shaft 78 and the bearing shell 84 are shown in FIG. 3; in an exemplary embodiment that is not shown, the angle is less than 60°). This produces a chamber 112 in which a hydrostatic counteracting force, which counteracts the forces coming from the piston 94, is generated in a manner that will be explained below.

In the same manner, but offset by 180°, a radial bore 114 branches outward from the axial bore 108 in the vicinity of the eccentric section 86, and in an analogous manner, feeds into a chamber 116. As shown in FIG. 4, this chamber 116 also extends in the azimuth direction over an angular range of approximately 60° (in an exemplary embodiment that is not shown, this angle is less than 60°). Here, too, FIG. 4 depicts only the shaft 78 and the bearing race 88 for the sake of clarity.

The high-pressure fuel pump 20 functions as follows:

Because of the eccentric section 86, a rotation of the drive shaft 78 sets the piston 94 into an axial reciprocating motion. The control and regulation unit 32 triggers the on-off valve 56 so that it is closed at first during a delivery stroke of the piston 94, i.e. when the piston is moving upward. This increases the pressure of the fluid enclosed in the working chamber 100 considerably. By means of the flow conduit 50, which is not visible in FIG. 2, the compressed fluid travels out of the working chamber 100 into the fuel accumulation line 24. The pressure sensor 30 detects when the desired pressure in the fuel accumulation line 24 has been achieved.

The control and regulation unit 32 then triggers the on-off valve 56 so that it opens. As a result, the fluid connection opens between the working chamber 100 and the chambers 112 and 116 of the hydrostatic bearing 62. This increases the pressure in the chambers 112 and 116, which generates a hydrostatic counteracting force in the desired direction between the bearing shell 84 and the drive shaft 78 (shaft bearing) and on the other hand between the bearing race 88 and the drive shaft 78 (piston bearing). At the end of the delivery stroke, the control and regulation unit 32 closes the on-off valve 56 again, which interrupts the fluid connection once more between the working chamber 100 and the two chambers 112 and 116.

However, the closing of the on-off valve 56 does not immediately terminate the hydrostatic counteracting force generated in the chambers 112 and 116. First of all, it takes a certain amount time for the fluid to drain out through the gaps on the one hand between the drive shaft 78 and the bearing shell 84 and on the other hand between the drive shaft 78 and the bearing race 88. Secondly, the pressure damper 66 functions as a pressure reservoir, which continues to supply a certain quantity of fluid into the chambers 112 and 116 even when the on-off valve 56 is closed.

Figure 5:
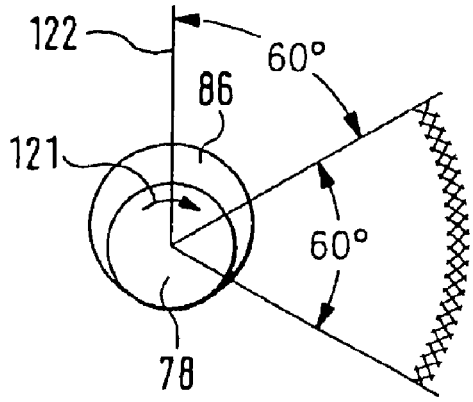
FIG. 5 is a representation of the angular range of a force vector of the fuel pump from FIG. 2 in relation to the longitudinal axis of a drive shaft.

The chronological progression of the hydrostatic counteracting force generated by the pressure buildup in the chambers 112 and 116 is determined on the one hand by the width and the azimuth angular span of the chambers 112 and 116 and on the other hand by the properties of the pressure damper 66 and the two flow throttles 68 and 70. As mentioned above, the azimuth angular span of the chambers 112 and 116 is maximally 60°; in any case in a multicylinder pump, this angular span is maximally 360°/2 times the number of cylinders, or 60° with the three cylinders here. This angular span is a result of the following considerations:

As shown in FIG. 5, the force vector resulting from the exertion of pressure on the pistons of the cylinders 40*a* to 40*c* in the current three-cylinder high-pressure pump 20 varies in a range of approximately 60° depending on the angular position of the drive shaft 78. The beginning of the range is once again offset by approximately 60° in the rotation direction (arrow 121 in FIGS. 4 and 5) in relation to an axis 122, which rotates with the shaft and points in the eccentricity direction. Within the above-mentioned angular range, the force vector rotates synchronously with the drive shaft 78 around its longitudinal axis. Starting from this loading phase, the unloading phase occurs by means of the hydrostatic force on the piston bearing (bearing race 88 and shaft 78) in the vicinity of the chamber 116 and on the shaft bearing (bearing shell 84 and shaft 78) offset from this by 180°, in the vicinity of the chamber 112.

In the exemplary embodiment shown in FIGS. 1 to 5, the hydrostatic bearing 62 has hardly any negative influence on the efficiency of the pump 10 since the hydrostatic bearing 62 is produced using only fluid, which the on-off valve 56 is already expending anyway for pressure control. Therefore no additional leakage is required to produce the hydrostatic bearing.

Figure 7:
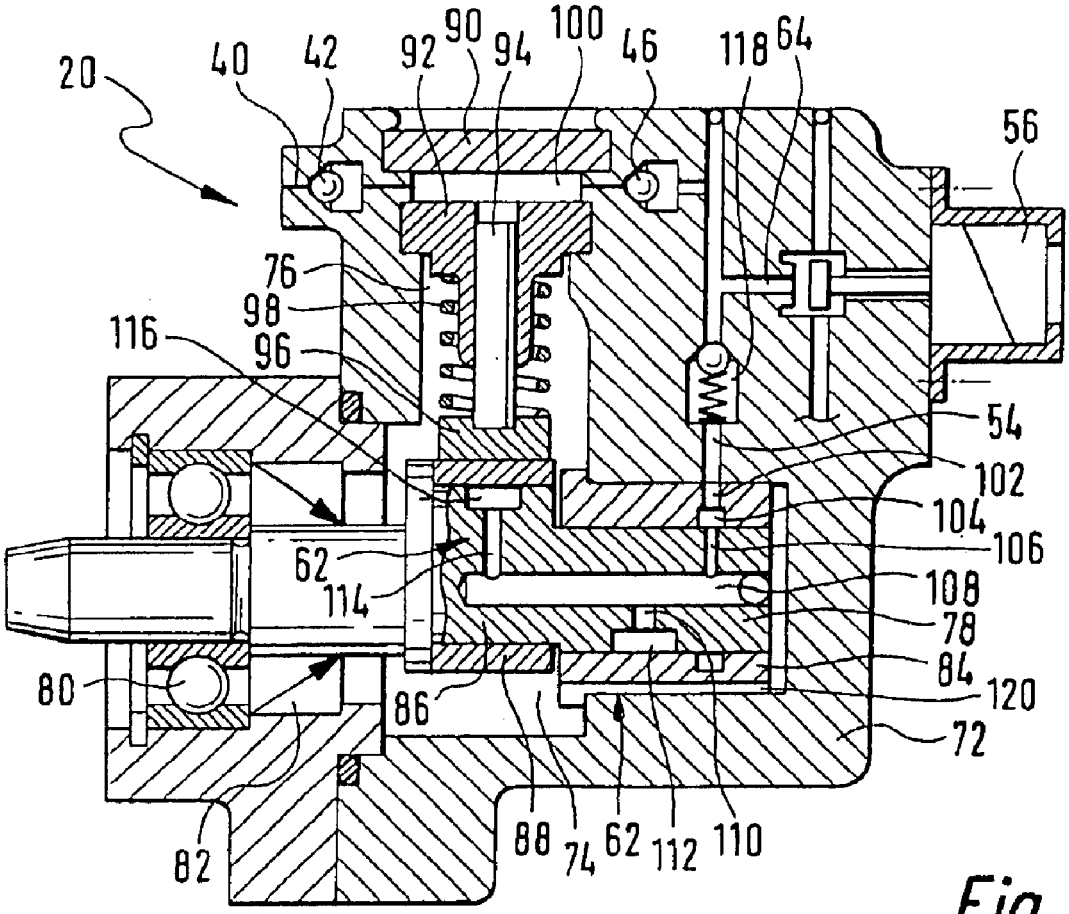
FIG. 7 is a representation similar to FIG. 2 of the fuel pump from FIG. 6.
Figure 6:
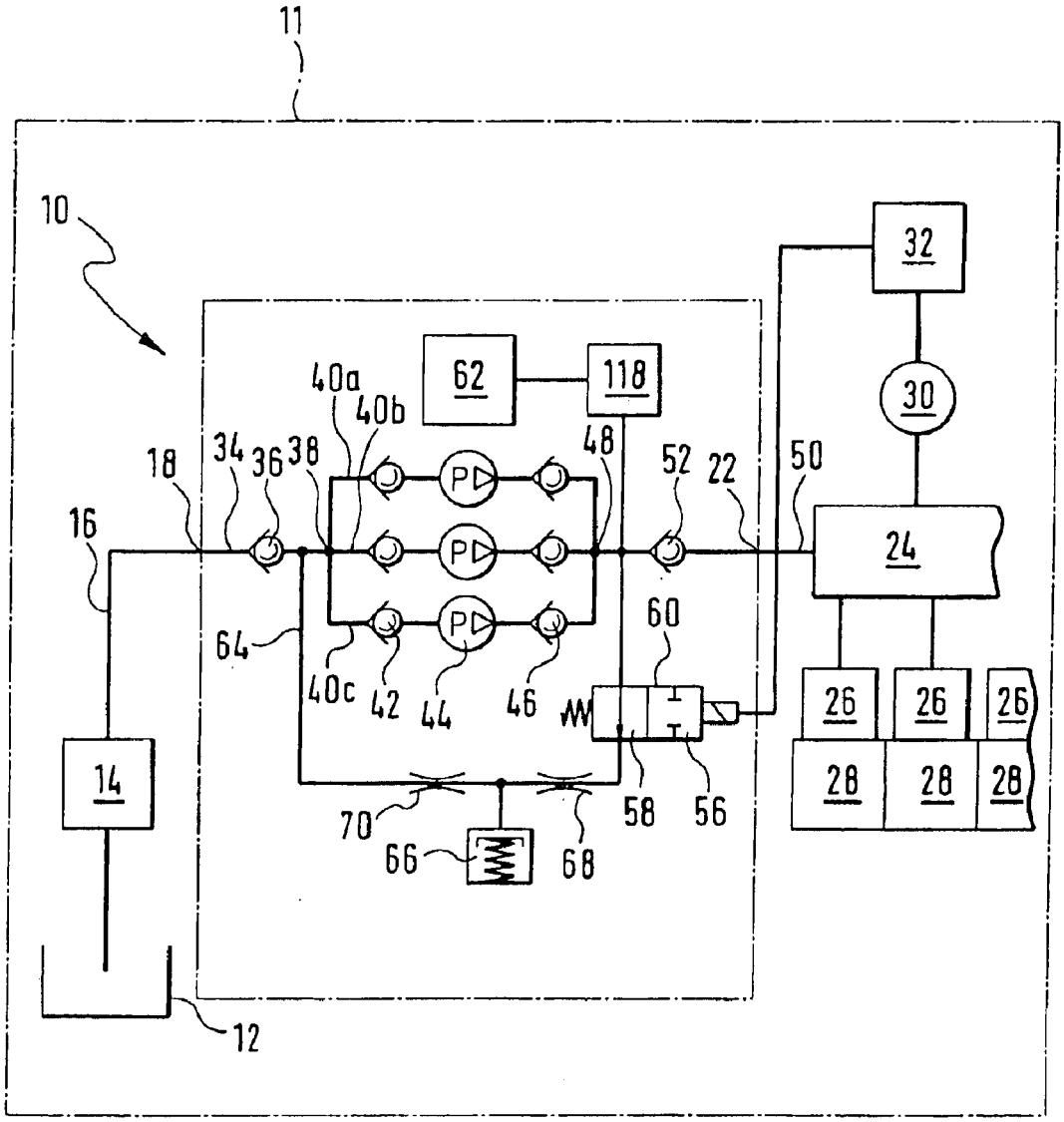
FIG. 6 is a representation similar to FIG. 1 of a fuel system with a second exemplary embodiment of a fuel pump.

FIGS. 6 and 7 show a second exemplary embodiment of a high-pressure fuel pump 20. Parts, elements, and regions, which have functions equivalent to those of parts, elements, and regions described previously, have been provided with the same reference numerals and are not explained again in detail.

By contrast to the exemplary embodiment described above, instead of an on-off valve, a pressure relief valve 118 is disposed in the fluid connection 54 between the working chamber 100 and chambers 112 and 116. This pressure relief valve 118 opens the fluid connection 54 only when the pressure in the working chamber 100 exceeds a certain threshold value. As a result, the hydrostatic counteracting force only becomes fully effective above the opening pressure of the pressure relief valve 118.

The advantage to this is that—without the need for an electric triggering—at low pressures in the working chamber 100, no fluid flows in the form of leakage through the chambers 112 and 116 and the corresponding bearing gaps on the one hand between the drive shaft 78 and the bearing shell 84 and on the other hand between the drive shaft 78 and the bearing race 88, which results in a higher volumetric efficiency of the high-pressure fuel pump 20. In the upper pressure range, a higher leakage does in fact occur, but this is at least compensated for with regard to the overall efficiency due to the lower bearing load and the resulting higher mechanical efficiency. In any case, independent of the efficiency, this results in a considerably extended service life of the high-pressure fuel pump 20.

In addition to the first exemplary embodiment, an additional axially extending groove 120 is provided on the inside of the bearing shell 84. This groove extends from the chamber provided to the right of the bearing shell 84 to the space in the recess 74 provided to the left of the bearing shell 84. The groove 120 prevents a pressure buildup from occurring at the end face due to the leakage between the drive shaft 78 and the bearing shell 84, which could produce impermissibly high axial forces on the drive shaft 78. The space provided in the horizontal recess 74 to the left of the bearing shell 84 is connected in a manner not shown in detail here to the inlet 18 of the high-pressure fuel pump 20.

Figure 8:
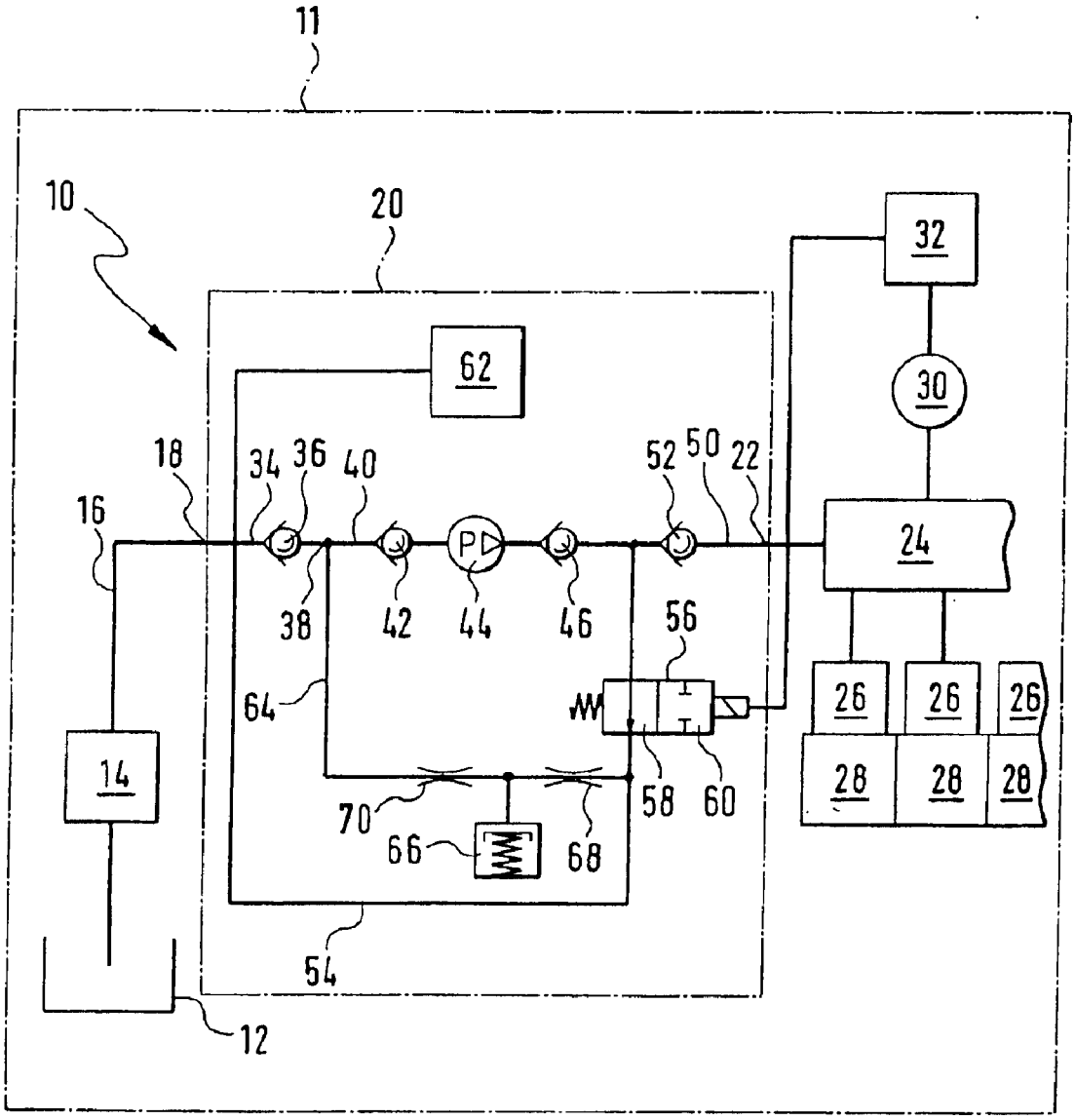
FIG. 8 is a representation similar to FIG. 1 of a fuel system with a third exemplary embodiment of a fuel pump.

FIG. 8 shows another exemplary embodiment of a high-pressure fuel pump. Here, too, components and regions whose functions are equivalent to those of corresponding components and regions in the preceding figures are provided with the same reference numerals and are not explained again in detail.

Figure 9:
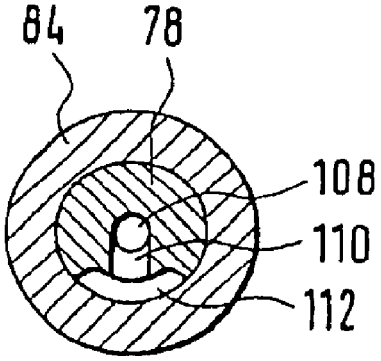
FIG. 9 is a representation analogous to FIG. 3 of the corresponding region of the fuel pump from FIG. 8.
Figure 10:
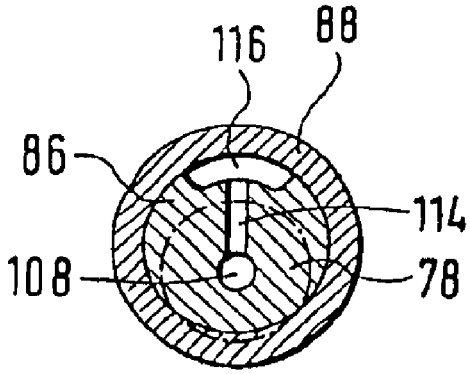
FIG. 10 is a representation analogous to FIG. 4 of the corresponding region of the fuel pump from FIG. 8.
Figure 11:
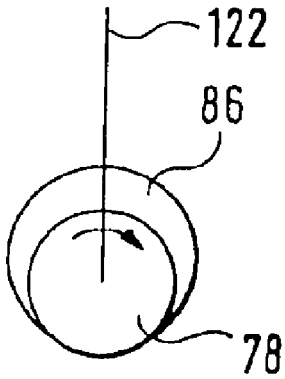
FIG. 11 is a representation of the angular range of a force vector of the fuel pump from FIG. 8 in relation to the longitudinal axis of a drive shaft.

In contrast to the exemplary embodiments shown in FIGS. 1 and 6, FIG. 8 depicts a 1-cylinder piston pump 20. Among other things, this also results in a different orientation of the chambers 112 and 116, as shown in FIGS. 9 and 10. According to them, the chamber 116 is disposed in a range of approximately 60° on both sides of the eccentricity axis 122. It therefore has approximately twice the angular span of the corresponding chamber in the preceding exemplary embodiments. In addition, it is offset by 90° counter to the rotation direction of the drive shaft 78 in comparison to the preceding exemplary embodiments. The chamber 112 is offset from the chamber 116 by 180°, i.e. is disposed with its center axis opposite from the eccentricity axis 122. The force vector in this 1-cylinder fuel pump 20 always acts exclusively in the direction of the cylinder axis, which as shown in FIG. 11, coincides with the eccentricity axis 122 at the top dead center.

The foregoing relates to preferred exemplary embodiments of the invention, it being understood that other variants and embodiments thereof are possible within the spirit and scope of the invention, the latter being defined by the appended claims.

I claim:

1. A high-pressure piston pump (20) for a fuel system (10) of an internal combustion engine, comprising:

a housing (72), at least one piston (94) that defines a working chamber (100), a drive shaft (78) that is supported in the housing (72) by at least one shaft bearing and has at least one crank section (86), a piston bearing that supports the piston (94) at least indirectly against the crank section (86) of the shaft (78), at least one of the bearings between parts that move in relation to one another being a hydrostatic bearing (62), and means operable to intermittently interrupt the fluid connection between the working chamber (100) and the hydrostatic bearing (62), wherein the means operable to intermittently interrupt the fluid connection includes an on-off valve (56).

2. The piston pump (20) according to claim 1, further comprising a pressure relief valve (118) included in the means operable to intermittently interrupt the fluid connection.

3. The piston pump (20) according to claim 2, wherein the means operable to intermittently interrupt the fluid connection includes an on-off valve (56).

4. The piston pump (20) according to claim 1, wherein the on-off valve is the quantity control valve (56) of the piston pump.

5. The piston pump (20) according to claim 1, wherein the means operable to intermittently interrupt the fluid connection is accommodated in the piston (94).

6. The piston pump (20) according to claim 1, wherein the means (56; 118) operable to intermittently interrupt the fluid connection is accommodated in the housing (72).

7. The piston pump (20) according to claim 1, wherein at least one hydrostatic bearing (62) is respectively provided in the piston bearing and in the shaft bearing.

8. The piston pump (20) according to claim 1, wherein the hydrostatic bearing (62) includes at least one chamber (112, 116), which is limited in the azimuth direction.

9. The piston pump (20) according to claim 7, wherein the hydrostatic bearing (62) includes at least one chamber (112, 116), which is limited in the azimuth direction.

10. The piston pump (20) according to claim 8, wherein the pump has a number of radially distributed pistons (94), wherein the angular range over which the chamber (112, 116) extends in the azimuth direction is preferably less than or equal to 360°/2 times the number of pistons (94), and wherein this range is offset by approx. 60° in the rotation direction in relation to an axis (122), which rotates with the shaft and points in the eccentricity direction.

11. The piston pump (20) according to claim 1, further comprising a pressure damper (66) connected to the fluid connection.

12. The piston pump (20) according to claim 10, further comprising a pressure damper (66) connected to the fluid connection.

13. The piston pump (20) according to claim 11, further comprising at least one flow throttle (68) connected between the fluid connection and the pressure damper (66).

14. The piston pump (20) according to claim 8, wherein the fluid connection to the chamber (112) in the shaft bearing includes a flow conduit (54) in the housing (72), which is connected to an annular groove (104) in a bearing shell (84) or in the shaft, which annular groove (104) is connected to a radial bore (106) in the shaft (78), which radial bore (106) is connected to an axial bore (108) in the shaft (78), which axial bore (108) is connected to a radial bore (110) in the shaft (78), which radial bore (110) feeds into the chamber (112) in the shaft bearing.

15. The piston pump (20) according to claim 11, wherein the fluid connection to the chamber (112) in the shaft bearing includes a flow conduit (54) in the housing (72), which is connected to an annular groove (104) in a bearing shell (84) or in the shaft, which annular groove (104) is connected to a radial bore (106) in the shaft (78), which radial bore (106) is connected to an axial bore (108) in the shaft (78), which axial bore (108) is connected to a radial bore (110) in the shaft (78), which radial bore (110) feeds into the chamber (112) in the shaft bearing.

16. The piston pump (20) according to claim 13, wherein the fluid connection to the chamber (112) in the shaft bearing includes a flow conduit (54) in the housing (72), which is connected to an annular groove (104) in a bearing shell (84) or in the shaft, which annular groove (104) is connected to a radial bore (106) in the shaft (78), which radial bore (106) is connected to an axial bore (108) in the shaft (78), which axial bore (108) is connected to a radial bore (110) in the shaft (78), which radial bore (110) feeds into the chamber (112) in the shaft bearing.

17. The piston pump (20) according to claim 14, wherein the fluid connection to the chamber (116) in the piston bearing includes a radial bore (114) that leads away from the axial bore (108) in the shaft (78) and feeds into the chamber (116) in the piston bearing.

18. A high-pressure piston pump (20) for a fuel system (10) of an internal combustion engine, comprising:

a housing (72), at least one piston (94) that defines a working chamber (100), a drive shaft (78) that is supported in the housing (72) by at least one shaft bearing and has at least one crank section (86), a piston bearing that supports the piston (94) at least indirectly against the crank section (86) of the shaft (78), at least one of the bearings between parts that move in relation to one another being a hydrostatic bearing (62), and means operable to intermittently interrupt the fluid connection between the working chamber (100) and the hydrostatic bearing (62), wherein the means operable to intermittently interrupt the fluid connection is accommodated in the piston (94).

* * * * *

UNITED STATES PATENT AND TRADEMARK OFFICE

CERTIFICATE OF CORRECTION

PATENT NO. : 6,889,665 B2
APPLICATION NO. : 10/333715
DATED : May 10, 2005
INVENTOR(S) : Helmut Rembold It is certified that error appears in the above-identified patent and that said Letters Patent is hereby corrected as shown below:

Title page,
Item [86], should read as follows:

-- (86) PCT No.: PCT/DE02/01888
371 (c)(1),
(2), (4) Date: September 26, 2003

Signed and Sealed this

Twenty-ninth Day of August, 2006

JON W. DUDAS
*Director of the United States Patent and Trademark Office*